US011286735B2

(12) United States Patent
Kyllingstad et al.

(10) Patent No.: US 11,286,735 B2
(45) Date of Patent: Mar. 29, 2022

(54) SYSTEM AND METHOD FOR CALIBRATION OF HYDRAULIC MODELS BY SURFACE STRING WEIGHT

(71) Applicant: National Oilwell Varco Norway AS, Kristiansand S (NO)

(72) Inventors: Åge Kyllingstad, Ålgård (NO); Karl Erik Thoresen, Hafrsfjord (NO)

(73) Assignee: National Oilwell Vareo Norway AS

( * ) Notice: Subject to any disclaimer, the term of this patent is extended or adjusted under 35 U.S.C. 154(b) by 9 days.

(21) Appl. No.: 16/760,976

(22) PCT Filed: Nov. 27, 2018

(86) PCT No.: PCT/NO2018/050295
§ 371 (c)(1),
(2) Date: May 1, 2020

(87) PCT Pub. No.: WO2019/103624
PCT Pub. Date: May 31, 2019

(65) Prior Publication Data

US 2020/0308918 A1 Oct. 1, 2020

(30) Foreign Application Priority Data

Nov. 27, 2017 (EP) ..... 17203743

(51) Int. Cl.
*E21B 21/08* (2006.01)
*E21B 47/06* (2012.01)
(Continued)

(52) U.S. Cl.
CPC ..... *E21B 21/08* (2013.01); *E21B 47/06* (2013.01); *E21B 44/06* (2013.01); *E21B 47/007* (2020.05); *E21B 47/12* (2013.01); *E21B 2200/20* (2020.05)

(58) Field of Classification Search
CPC ..... E21B 21/08; E21B 47/06; E21B 2200/20; E21B 47/007; E21B 44/06; E21B 47/12
See application file for complete search history.

(56) References Cited

U.S. PATENT DOCUMENTS

2016/0341027 A1* 11/2016 Kyllingstad ..... G06F 30/17
2017/0122092 A1 5/2017 Richard
(Continued)

FOREIGN PATENT DOCUMENTS

WO 2010101473 9/2010

OTHER PUBLICATIONS

Iversen, F.P.; Monitoring and controlling of drilling utilizing continuously updated process models, IADC/SPE Drilling conference, Miami, Florida, USA, Feb. 21-23, 2006, IADC/SPE 99207 (10 pages).

(Continued)

*Primary Examiner* — Brad Harcourt
(74) *Attorney, Agent, or Firm* — Conley Rose, P.C.

(57) ABSTRACT

Disclosed is a method and system for tuning a hydraulic model to be used for estimating down hole dynamic pressure as a function of flow rate includes:

a) selecting a non-tuned hydraulic model estimating the relative magnitude of the pressure losses in various annulus sections of the well bore;
b) applying the non-tuned hydraulic model to give a first order estimate of the pressure gradients and the shear stresses at the drill string;
c) applying the same non-tuned model to estimate the flow lift area for two different flow rates, where the first flow rate is zero or much lower than the second flow rate being substantially equal to a typical flow rate obtained during drilling; and (Continued)

Graph showing how the flow induced lift force $F_q$, pressure loss $P_q$ and the ratio $A_q=F_q/P_q$ of a 3500m long string vary as a function of mud circulation flow rate.

d) performing a model tuning test where the string is rotated off bottom while said two different flow rates are used to obtain corresponding string weights.

15 Claims, 1 Drawing Sheet

(51) Int. Cl.

| | |
|---|---|
| *E21B 47/007* | (2012.01) |
| *E21B 44/06* | (2006.01) |
| *E21B 47/12* | (2012.01) |

(56) References Cited

U.S. PATENT DOCUMENTS

| | | | | |
|---|---|---|---|---|
| 2018/0202280 | A1* | 7/2018 | Williams | E21B 47/00 |
| 2021/0131251 | A1* | 5/2021 | Bhatnagar | E21B 43/261 |

OTHER PUBLICATIONS

Cayeux, E. et al. Early detection of drilling conditions deterioration using realtime calibration of computer models: field example from north sea drilling operations, SPE/IADC Drilling conference and exhibition, Amsterdam, The Netherlands, Mar. 17-18, 2009, SPE/IADC 119435 (13 pages).

Rommetveit, R. et al., Drilltronics: An integrated system for real-timeo ptimization of the drilling process, IADCISPE Drilling conference, Dallas, Texas, USA, Mar. 2-4, 2004, IADC/SPE 87124 (8 pages).

Kaasa, G. Intelligent estimation of downhole pressure using a simple hydraulic model, IADC/SPE Managed pressure drilling and underbalanced operations conference and exhibition, Denver, Colorado, USA, Apr. 5-6, 2011, IADC/SPE 143097 (13 pages).

International Search Report for PCT/NO2018/050295 dated Jan. 30, 2019 (4 pages).

Written Opinion for PCT/NO2018/050295 dated Jan. 30, 2019 (6 pages).

* cited by examiner

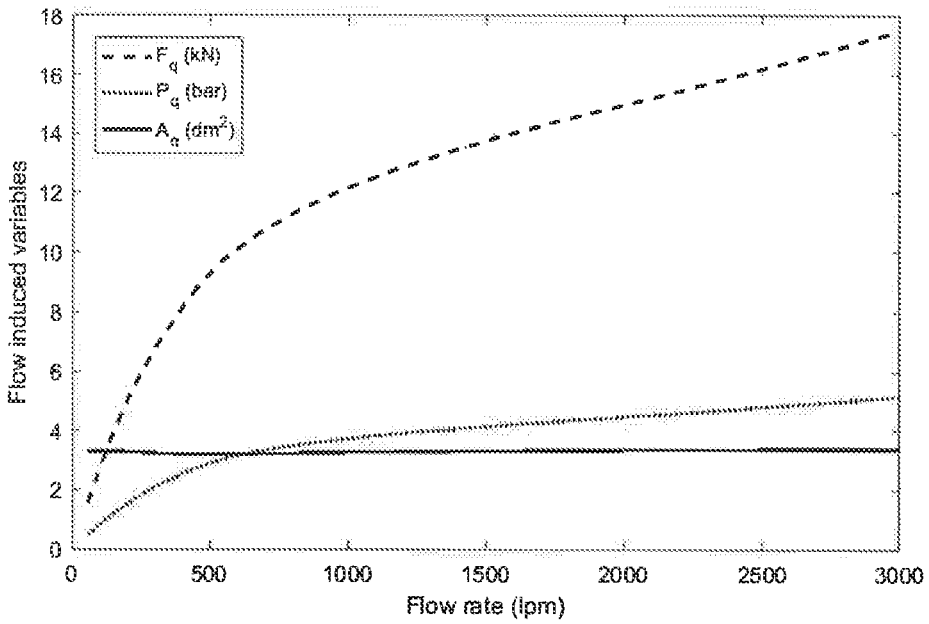
Graph showing how the flow induced lift force $F_q$, pressure loss $P_q$ and the ratio $A_q=F_q/P_q$ of a 3500m long string vary as a function of mud circulation flow rate.

SYSTEM AND METHOD FOR CALIBRATION OF HYDRAULIC MODELS BY SURFACE STRING WEIGHT

CROSS REFERENCE TO RELATED APPLICATIONS

This application is a 35 U.S.C. § 371 national stage application of PCTN02018/050295 filed Nov. 27, 2018 and entitled "System and Method for Calibration of Hydraulic Models by Surface String Weight", which claims priority to European Patent Application No. 17203743.4 filed Nov. 27, 2017, each of which is incorporated herein by reference in their entirety for all purposes.

STATEMENT REGARDING FEDERALLY SPONSORED RESEARCH OR DEVELOPMENT7

Not applicable.

STATEMENT REGARDING FEDERALLY SPONSORED RESEARCH OR DEVELOPMENT

Not Applicable.

FIELD OF THE DISCLOSURE

Background

This application is a 35 U.S.C. § 371 national stage application of PCT/NO2018/050224 filed Sep. 7, 2018 and entitled "Electrohydraulic Device, Method, and Marine Vessel or Platform", which claims priority to European Patent Application No. 17190129.1 filed Sep. 8, 2017, each of which is incorporated herein by reference in their entirety for all purposes.

Many of the wells being drilled today have small pressure margins, meaning that there is a relatively small difference between the fracture pressure and pore pressure. The fracture pressure is the threshold beyond which the formation is damaged, and the drilling mud tends to flow into cracks in the formation. The pore pressure is the lower pressure limit indicating when formation fluids or gas starts to flow into the well and mix with the drilling mud. Violation of these limits leads to situations commonly called loss and kick, respectively. Both situations are dangerous and can, if not handled quickly and properly, lead to disastrous blowouts. It is therefore important to know the downhole pressure and to have a control system that always maintains the pressure between the mentioned upper and lower limits. Downhole pressure in this context means the well bore pressure in an open hole zone where there is no casing to isolate the well bore from the formation.

The downhole pressure consists of two components, the hydrostatic pressure and the dynamic pressure. The former is the pressure when there is no circulation of the drilling mud and the string is not moving axially, i.e. upwards or downwards. The dynamic pressure is the extra pressure induced by fluid flow and/or axial string motion. The pressure increase resulting from a downwards motion is called surge pressure while the pressure reduction from moving the string upwards is called swab pressure.

The hydrostatic pressure can be calculated with a relatively high accuracy from the density of mud in the well bore trajectory and the true vertical depth. The dynamic pressure is far more difficult to determine, and it must be calculated from very uncertain hydraulic models. The best option until now has been to measure the downhole pressure directly, either by a MWD tool communicating to the surface via slow mud pulse telemetry, or by wired pipe offering much higher data rates. Often none of these options are available for the driller, implying that he/she needs to rely solely on the hydraulic models when estimating the downhole pressure under different conditions

SUMMARY OF THE DISCLOSURE

An object of the present description is to remedy or at least reduce one of the drawbacks of the prior art, or at least provide a useful alternative to the prior art. This object is achieved through features, which are specified in the description below and in the claims that follow.

This specification describes a system and a method that, under certain conditions, can measure the downhole pressure indirectly from the string weight and use these measurements to tune or calibrate the used hydraulic model. The system and method may include an accurate load cell measuring the string tension (weight) at the top of the string. The system and method may also include a basic hydraulic model describing how the pressure loss gradient varies with the annulus geometry. The system and method described herein are quite robust against model errors, meaning that the system and method have the potential of providing far more accurate estimates than the pure hydraulic model itself. There is also described a computer-readable medium including instructions for carrying out the method described herein.

The method and system described herein are intended to provide indirect measurements of the downhole pressure when direct pressure measurements are not available. In a first aspect, the disclosure relates to a method for tuning a hydraulic model to be used for estimating down hole dynamic pressure as a function of flow rate, wherein the method comprises the steps of:

a) selecting a non-tuned hydraulic model estimating the relative magnitude of the pressure losses in various annulus sections of the well bore;
b) applying the non-tuned hydraulic model to give a first order estimate of the pressure gradients and the axial shear stresses at the drill string;
c) applying the same non-tuned model to estimate the flow lift area for two different flow rates, where the first flow rate is zero or much lower than the second flow rate being substantially equal to a typical flow rate obtained during drilling; and
d) performing a model tuning test where the string is rotated off bottom while said two different flow rates are used to obtain corresponding string weights.

In a second aspect, the disclosure relates to a system for tuning a hydraulic model to be used for estimating down hole dynamic pressure as a function of flow rate, wherein said system comprises a weighing device, apparatus or system, and a control unit, where said control unit is configured to:

a) select a non-tuned hydraulic model estimating the relative magnitude of the pressure losses in various annulus sections of the well bore;
b) apply the non-tuned hydraulic model to give a first order estimate of the pressure gradients and the axial shear stresses at the drill string;
c) apply the same non-tuned model to estimate the flow lift area for two different flow rates, where the first flow rate is zero or much lower than the second flow rate being substantially equal to a typical flow rate obtained during drilling; and d) perform a model tuning test where the string is rotated off bottom while said two different flow rates are used to obtain corresponding string weights by means of said weighing device, apparatus or system.

In a third aspect, the disclosure relates to a computer-readable medium provided with instructions to carry out a method according to the first aspect of the disclosure.

Basic Theory

The annulus pressure can be formally written as the following integral.

$$p(x)=p(0)+\int_0^x(\rho_o g\cos\theta+p'_q)dx \quad (1)$$

Here $\rho_o$ is the fluid density, g is the acceleration of gravity, θ is well inclination (deviation from vertical) and $p'_q$ is the dynamic pressure gradient (the prime symbol ' here denotes derivation with respect to the depth variable x). We have also included an optional pressure at the top of the string p(0) in case there is a sealing device (for instance a rotary seal and a choke) that creates an exit pressure. Throughout, for simplicity, we shall assume that the pressure is gauge pressure so that p(0)=0 if the return flow is without restriction to the ambient atmospheric pressure.

The first term of the integrand is the axial component of the hydrostatic pressure gradient. It is to be noted that the mud density is often treated as a constant, but it is generally a function of both pressure and temperature. Compressibility tends to increase the density as the vertical depth increases while thermal expansion has the opposite effect: it makes the density decrease with temperature and depth. Very often, if the mud temperature follows the natural geothermal temperature profile of the earth crust, the thermal effect is the dominating one, thus making the density decreasing slightly with vertical depth.

The dynamic pressure gradient $p'_g$ is a function of many variables. The most important ones are the annulus geometry (well bore diameter $d_w$ outer string diameter $d_o$ and string eccentricity), pump rate and string speed. However, the mud rheology (viscosity) also plays an important role. The rotation speed of the string has a minor effect on the dynamic pressure gradient, and is often neglected. A complicating factor is that the rheology is often strongly non-Newtonian, meaning that the shear stress is far from a linear function of the shear rate, as it is for Newtonian fluids. Often the rheology also varies with time. The dynamic pressure gradient is therefore extremely difficult to predict accurately. While the hydrostatic pressure can be determined within a few percent's accuracy, the dynamic pressure estimate will often be off either ways by a factor 2 or more.

There exist different hydraulic models that predict how the dynamic pressure gradient $p'_q$ vary with the mentioned variables. American Petroleum Institute (API) provides one relatively advanced model in their API Recommended practice 13D called *Rheology and Hydraulics of Oil-well Fluids*, to which reference is made for an in-depth disclosure of the mentioned model. It is beyond the scope of this disclosure to repeat the details of this model, but the model provides relatively advanced analytical expressions for the pressure gradient as a function of flow, and annulus geometry for non-Newtonian fluids. The model is adapted to handle both laminar and turbulent flow in addition to the eccentricity effect. This API model and even more advanced hydraulic models may be used subsequently to estimate the coupling between the downhole pressure and string weight in a system and method according to this disclosure.

The tension in the string can be described by the following integral $$F(x)=F_b+\int_x^L(w\cos\theta+\mu_a f_c-A_o p'_q-\pi d_o\tau_o)dx \quad (2)$$

Here $F_b$ represents the tension, minus weight on bit (WOB) at the lower end of the string, w is the buoyant weight per unit length, θ is the inclination, $\mu_a$ is the axial friction coefficient, $f_c$ is the normal contact force per unit length, $A_o=(\pi/4)d_o^2$ is the outer string cross-sectional area and $\tau_0$ is the flow-induced axial shear stress at the outer string surface (averaged over all directions if eccentricity is included). The specific buoyant weight can be expressed by the sum of pipe weight and inner mud weight minus the buoyancy weight. That is $$w=(\rho_s A_s+\rho_i A_i-\rho_o A_o)g \quad (3)$$

where $\rho_s$, $\rho_1$ and $\rho_0$ are the densities of the string (steel), inner mud and annular mud, respectively and $A_s=A_o-A_i$, $A_i$ and $A_o$ represent the corresponding cross-sectional areas. Finally, g is the acceleration of gravity. The first and second terms of the integrand of equation 2 therefore represent gravitation force and well bore friction force, respectively. The two last terms represent two different components of what is conveniently called hydraulic lift force. The first is a kind of dynamic buoyancy resembling to the classical Archimedes buoyancy (being a part of the first term) but instead of being vertical and thereby proportional to cos θ, it is acting in the axial direction and is therefore independent of the inclination.

Various of the terms in equation 2 have been discussed previously in the scientific literature. See for instance section 3.2 in: E. Cayeux and H. J. Skadsem: *Estimation of Weight and Torque on Bit: Assessment of Uncertainties, Correction and Calibration Methods* Proceedings of the ASME 2014 33rd International Conference on Ocean, Offshore and Arctic Engineering, Jun. 8-13, 2014, San Francisco, Calif., USA, to which reference is made for an in-depth discussion of the constituents of equation 2. However, the discovery that the dynamic, flow-induced downhole pressure is so closely related to the hydraulic lifting force on the string is not believed to have been previously-described. The two effects are nearly proportional and can be represented by a flow lift area that can be estimated as justified below.

In the following we shall simplify to cases where the string is rotating off bottom without any axial motion. Then the bit force and axial friction vanish, $F_b=0$ and $\mu_a=0$ so that the tension at the top of the string can be written $$F(0)=\int_0^L(w\cos\theta-A_o p'_q-\pi d_o\tau_o)dx=W_0-F_q \quad (4)$$

where $W_0$ denotes the buoyant, rotating off bottom weight at no flow, and $$F_q\int_0^L(A_o p'_q+\pi d_o\tau_o)dx \quad (5)$$

is the flow-induced lift force. It should be mentioned that reference weight $W_)$ has a tiny component of the dynamic pressure because the dynamic pressure affects the mud density and thereby also the buoyant weight of the string. However, this effect is negligibly small compared with the other dynamic lift effects.

It can be shown, from force balance of a differential fluid element, that the flow-induced pressure gradient can be written as $$p'_q = \frac{\pi d_o \tau_o - \pi d_w \tau_w}{A_a} = \frac{\pi d_o \tau_o}{\beta A_a} \tag{6}$$

where $A_a$ is the annular cross section area. In the last expression we have used the fact that the axial shear stress, $\tau_w$, at the well bore surface is normally negative (because the radial shear rate is negative). It means that $$\beta = \frac{d_o \tau_o}{d_o \tau_o - d_w \tau_w} \tag{7}$$

is a positive factor less than unity. It approaches $d_o/(d_o+d_w)$ or 0.5 for narrow annuli, that is when $d_w-d_o \ll d_w$.

The flow-induced lift force can now be written as $$F_q = \int_0^L (A_o + \beta A_a) p'_q dx \tag{8}$$

The downhole pressure can finally be written as $$p_q = \int_0^L p'_q dx = A_q F_q \tag{9}$$

where the flow lift area is $$A_q = \frac{\int_0^L (A_o + \beta A_a) p'_q dx}{\int_0^L p'_q dx} \tag{10}$$

This parameter cannot be calculatedwithout having a starting model predicting how the pressure gradient varies along the string. The great advantage of this approach (the last expression of equation 9) over direct application of the hydraulic model (the first expression of the same equation) is that the flow lift area is much more robust against model errors than the gradient and pressure itself. Because both integrands of equation 10 are proportional to the pressure gradient $p'_q$, a multiplicative error has no impact on neither the lift area estimate nor the weight-based estimate of the pressure. What is needed is that the model gives a correct ratio of the pressure drop for the various annulus sections. This is a far less restrictive requirement than having a good model predicting the downhole pressure directly. Moreover, if the downhole pressure is measured indirectly from the string weight, this can be used for improving the model accuracy by the following $$p'_{q,corr} = c p'_q \tag{11}$$

where the correction factor equals the ratio of measured and calculated downhole pressure, that is $$c = \frac{A_q F_q}{\int_0^L p'_q dx} \tag{12}$$

Before discussing in more detail the implementation of the various methods and techniques described herein, it is useful to calculate the order of magnitudes of the flow lift force, the dynamic pressure loss and the flow lift area. As an example, we use the data from a real, horizontal well which is 3500 m long with a true vertical depth of approximately 1800 m. The string comprises a 3300 m long 5 inch drill pipe section and a 200 m long 5.5 inch heavy weight drill pipe section. The well bore is, for simplicity, assumed to have a constant bore diameter of 12.25 inches

BRIEF DESCRIPTION OF DRAWINGS

FIG. 1 Graph showing how the flow induced lift force $F_1$, pressure loss $P_q$ and the ration $a_q=F_q/P_q$ of a 3500 m long string vary as a function of mud circulation flow rate.

DETAILED DESCRIPTION OF THE DISCLOSED EXEMPLARY EMBODIMENTS

Reference is made to FIG. 1 showing how the flow induced lift force $F_q$, the pressure loss $P_q$ and the ratio $A_q=F_q/P_q$ of the above string vary as a function of mud circulation flow rate. The hydraulic model used for calculating these curves is more advanced than the mentioned API model. The curves are calculated for a typical non-Newtonian mud commonly used in the drilling industry and the gradients include the effect of reduced cross section at the tool joints. In contrast to the API model, the applied model also includes the relatively weak effect of drill string rotation and the plotted curves are calculated with a string rotation speed of 60 rpm. Further comments to the theoretic results in the reference figure are the following.

The non-linearity causing the variable slope of both the force and pressure curves comes from the non-linear rheology characteristics of the mud, which follows the well-known Herschel-Bulkley rheology model tightly. The flow is laminar for most of the included flow rate span but the slight increase of the slopes at the highest flow rates indicate that the highest flow rates are close to the transition where the flow goes from laminar to turbulent. The ratio between the two curves, which has the dimension of a flow lift area, is surprisingly constant over the entire flow range. It has a minimum of 3.2 $dm^2$ (=0.032 $m^2$) at a flow rate of 500 liters per minute. Then increases slowly to about 3.4 $dm^2$ at the maximum flow rate.

Both the calculated flow induced pressure and the lift force are relatively small compared with their static values. The rotating of bottom weight is $W_0 \approx 480$ kN while the static downhole pressure at the bit is 179 bar=17.9e6 Pa. At a maximum flow rate of 3000 lpm the dynamic effects therefore a weight reduction of 3.6% weight reduction and a pressure increase of 2.9%. Practical considerations As the numerical example indicates, the hydraulic flow lift effect is relatively small compared with the buoyant string weight itself. This fact implies that the weighing device, such as a load cell, that is measuring the flow lift must be rather accurate, preferably more accurate than the traditional deadline anchor hook load. Therefore, it is recommended to use drilling apparatus having an inline and highly accurate load cell, either as an integrated part of the top drive output shaft or as a standalone sub installed just below the top drive shaft. The accuracy goal for this load cell may be 0.1% or better. If the load cell is based on strain gauges applied on the outer surface of the shaft it is important to measure also the inside pressure and correct the raw force signal (proportional to the axial strain) for the pressure cross-talk effect. The effect of temperature variations should also be considered because radial temperature gradients will cause internal thermal stresses and offset drift of the sensor signal. However, if the calibration test has a short duration, the variation of the inside mud temperature will probably have a minor or negligible effect on the calibration results below.

If an accurate, inline load cell is not available, the method is still applicable with a traditional dead line based hook load signal. Usually the accuracy of a dead line tension sensor is poor because of the sheave friction causing the dead line tension to deviate from the average tension of the lines strung between the crown block and the travelling block. However, these friction errors are much smaller under the test conditions with no axial motion of the string.

The following procedure may be used for tuning the hydraulic model by surface measurements.

1. Select a basic hydraulic model to be tuned, for instance the model recommended by API, or a more advanced one, if available.
2. Use the non-tuned hydraulic model to calculate a first order approximation for the steady state dynamic downhole pressures $p_o$ and $p_1$ for two different flow rates $q_o$ and $q_1$, where $q_o$ is either zero or much lower than $q_1$, while $q_1$ is approximately equal to flow rate to be used in drilling.
3. Use the same, non-tuned model to calculate also the flow lift area, $A_q$ for the highest flow rate. (A slightly more accurate alternative is to calculate the flow lift area for a series of different flow rates in the range [$q_0$ $q_1$] and use a flow rate weighted average of areas.)
4. Perform a two-step calibration test where the string is rotated off bottom while the pump rate is kept constant at the selected rates, $q_0$ and $q_1$. Measure (the time averages of) the corresponding string weights $F_0$ and $F_1$ when the string weight is fully stabilized.
5. Estimate the real downhole pressure increase by $\Delta p = (F_0 - F_1)/A_q$
6. Update the hydraulic model by multiplying the non-tuned pressure gradients by the correction factor $c = \Delta p/(p_1 - p_0)$ The tuned or calibrated model can now be used to provide more accurate values for the dynamic and total pressure also for conditions like drilling with the bit on bottom.

It is recommended to repeat the suggested tuning procedure at regular intervals, for instance at every connection when new drill pipes are added to the string and the pump must stop anyway. It is important that the standpipe pressure and return flow rate are stabilized before the weight readings are carried out. The readings themselves can be averages over short time intervals, e.g. in the order of 10 seconds. However, due to the mud compressibility and the big cushion effect of the inner pipe volume, there will be a significant time from a new value of pump rate is reached until the annular flow rate and therefore the flow lift force stabilizes. The entire tuning test can therefore take a few minutes in long and deep wells.

It should be noted that the above-mentioned embodiments illustrate rather than limit the invention that is defined by the claims set out below, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A method for tuning a hydraulic model to be used for estimating down hole dynamic pressure as a function of flow rate, comprising:

a) selecting a non-tuned hydraulic model estimating a relative magnitude of pressure losses in various annulus sections of a well bore;

b) applying the non-tuned hydraulic model to give a first order estimate of pressure gradients and axial shear stresses at a drill string;

c) applying the non-tuned hydraulic model to estimate a flow lift area for two different flow rates, where the first flow rate is zero, or lower than the second flow rate; and d) performing a model tuning test where the drill string is rotated off bottom while said two different flow rates are used to obtain corresponding string weights.

2. The method according to claim 1, further comprising:

e) using an observed weight difference and said estimated flow lift area to calculate a real dynamic downhole pressure.

3. The method according to claim 2, further comprising updating the non-tuned hydraulic model using the observed weight difference and said estimated flow lift area.

4. The method according claim 3 further comprising drilling a well bore while utilizing said calculated down hole dynamic pressure.

5. The method according to claim 2 further comprising using said down hole dynamic pressure to calculate a total down hole pressure.

6. A computer-readable medium provided with instructions to carry out the method of any of claim 1.

7. A system for tuning a hydraulic model to be used for estimating down hole dynamic pressure as a function of flow rate, comprising: a weighing device and a control unit, where said control unit is configured to:

a) select a non-tuned hydraulic model giving estimation of a relative magnitude of pressure losses in various annulus sections of a well bore;

b) apply the non-tuned hydraulic model to give a first order estimate of pressure gradients and axial shear stresses at a drill string;

c) apply the same non-tuned hydraulic model to estimate a flow lift area for two different flow rates, where the first flow rate is zero, or lower than the second flow rate; and d) perform a model tuning test where the drill string is rotated off bottom while said two different flow rates are used to obtain corresponding string weights by means of said weighing device.

8. The system according to claim 7, wherein the control unit further is configured to utilize an observed weight difference and said estimated flow lift area to determine a real dynamic downhole pressure.

9. The system according to claim 8, wherein the control unit further is configured to update the non-tuned hydraulic model by using the observed weight difference and said estimated flow lift area.

10. The system according claim 9, wherein the system further comprises a drilling apparatus to which said control unit is connected, wherein said control unit is configured to control said drilling apparatus in order to drill a well bore while utilizing said down hole dynamic pressure.

11. The system according to claim 8, wherein the control unit is configured to utilize said down hole dynamic pressure to find a total down hole pressure.

12. The system according to claim 7, wherein said weighing device includes a load cell.

13. The system according to claim 12, wherein said load cell has an accuracy of around 0.1% or better.

14. The system according to claim 12 further comprising a top drive having an output shaft and, wherein said load cell is an integrated part of the top drive output shaft.

15. The system according to claim 12 further comprising a top drive having an output shaft and, wherein said load cell is included in a standalone sub provided below a top drive shaft.

* * * * *